US005252284A

United States Patent [19]

Jurkovic et al.

[11] Patent Number: 5,252,284

[45] Date of Patent: Oct. 12, 1993

[54] METHOD OF PRODUCING SHAPED CELLULOSIC ARTICLES

[75] Inventors: Raimund Jurkovic, Lenzing; Heinrich Firgo; Dieter Eichinger, both of Vöcklabruck; Stefan Zikeli, Regau, all of Austria

[73] Assignee: Lenzing Aktiengesellschaft, Lenzing, Austria

[21] Appl. No.: 817,937

[22] Filed: Jan. 8, 1992

[30] Foreign Application Priority Data

Jan. 9, 1991 [AT] Austria ..... 32/91

[51] Int. Cl.[5] ..... D01F 2/00

[52] U.S. Cl. ..... 264/187

[58] Field of Search ..... 264/187, 207; 106/186, 106/198

[56] References Cited

U.S. PATENT DOCUMENTS

| | | | |
|---|---|---|---|
| 2,341,555 | 2/1944 | Jones . | |
| 3,414,645 | 12/1968 | Morgan, Jr. . | |
| 3,767,756 | 10/1973 | Blades . | |
| 4,246,221 | 1/1981 | McCorsley, III | 264/203 |
| 4,261,943 | 4/1981 | McCorsley, III | 264/187 X |
| 4,416,698 | 11/1983 | McCorsley, III | 106/186 X |
| 4,501,886 | 2/1985 | O'Brien | 536/57 |

FOREIGN PATENT DOCUMENTS

| | | | |
|---|---|---|---|
| 365663 | 6/1981 | Austria . | |
| 387792 | 8/1988 | Austria . | |
| 295672 | 12/1988 | European Pat. Off. . | |
| 0299824A1 | 1/1989 | European Pat. Off. . | |
| 0452619A2 | 10/1991 | European Pat. Off. . | |
| 218124 | 1/1985 | German Democratic Rep. . | |
| 1224362 | 4/1986 | U.S.S.R. | 264/187 |

OTHER PUBLICATIONS

Satou Eiji; "Spinneret for Spinning"; JP 59030909; Feb. 18, 1984; Asahi Kasei Kogyo KK.

English translation of U.S.S.R. 1,224,362 (published Apr. 15, 1986).

"Chemical Fiber Handbook"; Japan Fiber Society, 1958, p. 138.

*Primary Examiner*—Leo B. Tentoni

*Attorney, Agent, or Firm*—Herbert Dubno

[57] ABSTRACT

A cellulosic solution in a amine oxide and water is forced through an elongated orifice passage having a minimum length of 1000 /μm and a minimum diameter along the length which is up to 150 /μm so that fiber characteristics are imparted to the emerging strand which passes through an air gap of at the most 35 mm in length into the coagulating solution.

7 Claims, 1 Drawing Sheet

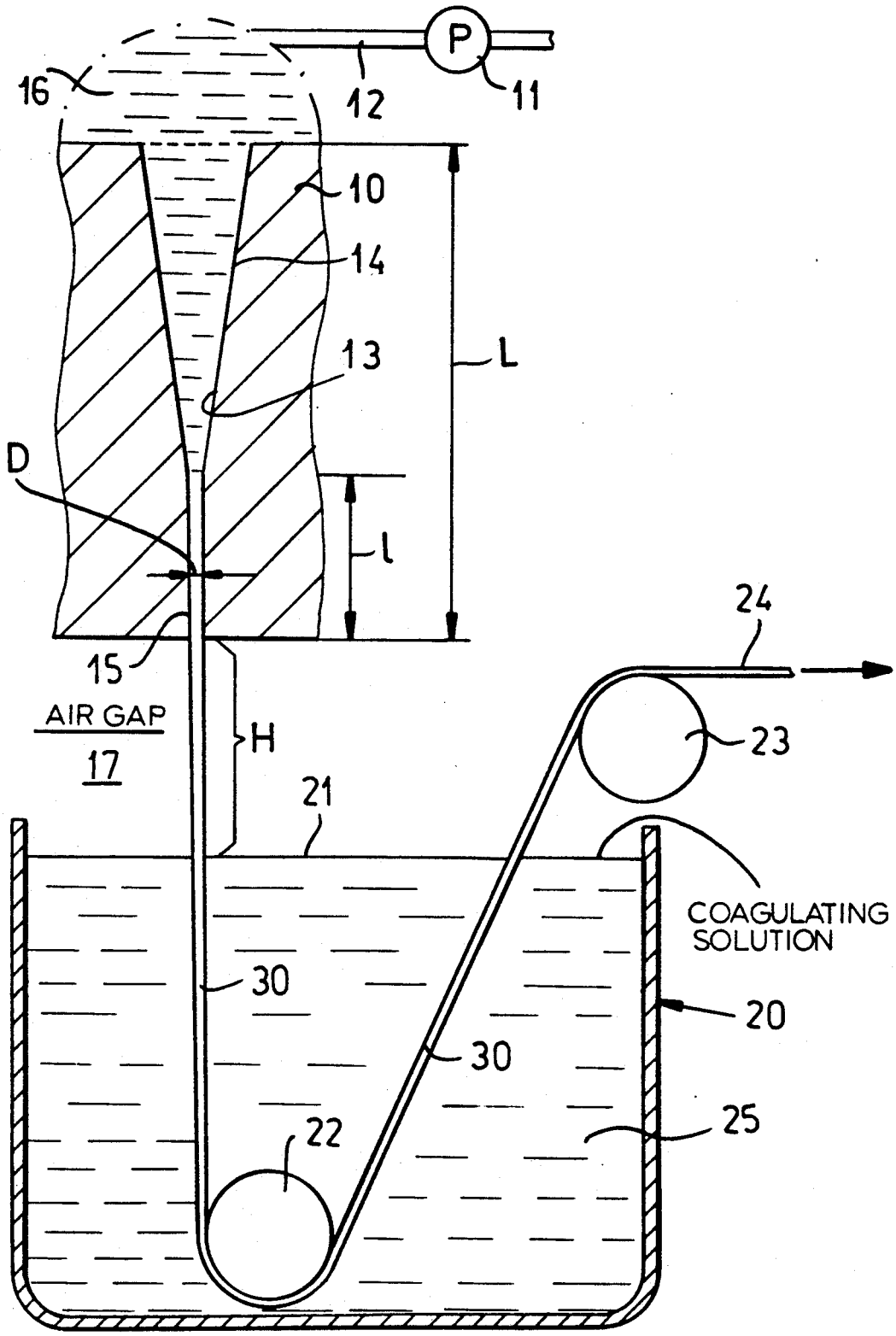
P
16
12
11
10
14
13
L
D
l
15
AIR GAP
17
H
24
23
21
COAGULATING
SOLUTION
30
20
30
25
22

METHOD OF PRODUCING SHAPED CELLULOSIC ARTICLES

CROSS-REFERENCE TO RELATED APPLICATION

This application is related to the commonly assigned co-pending application Ser. No. 07/797,126 filed Nov. 22, 1991, now U.S. Pat. No. 5,178,764, filed Dec. 6, 1991 and based upon Austrian application A2482/90 of Dec. 7, 1990 and corresponding to Austrian application 31/91 filed Jan. 9, 1991.

FIELD OF THE INVENTION

The present invention relates to a process for producing a shaped cellulosic body, for example a cellulosic filament, fiber or strand, in which a cellulosic amine oxide solution is forced through a nozzle orifice, the solution strand is then passed across an air gap and can optionally be stretched in this air gap and the strand is then stabilized in a coagulating or precipitating bath.

BACKGROUND OF THE INVENTION

Filaments with good characteristics can be fabricated from high polymers only when an oriented structure is generated in the strand (see the Ullmann Encyclopedia, 5th edition, volume A-10, page 456). It is desirable and indeed necessary for this purpose to align micro-oriented regions such as fibrides in the polymer along the fiber axis. This alignment of orientation can be effected by the various fabricating techniques used to produce such filaments and can depend upon the process to which the fiber or filament is subjected. In most cases the orientation is effected by a stretching.

The process steps and the conditions in which and under which this stretching is carried out has an impact upon the fiber properties which are produced. In melt spinning the fibers are stretched in a hot plastic state while the molecules are still mobile. Soluble polymers can be wet spun or dry spun. In dry spinning the stretching is effected while the solvent is removed or evaporated. Extruded fibers which are coagulated in a precipitating or coagulated bath are commonly stretched during the coagulation.

Processes of these types are well known and widely described. In all of these cases, however, it is important that the transition from the liquid state, independently of whether this is a melt state or solution state, to the solid state be so effected that during the filament formation an orientation of the polymer chain or of the polymer chain packets (with reference to fibrides, fibrils or the like) is brought about.

To inhibit the sudden evaporation of a solvent from a filament during dry spinning, there are a number of possibilities. However, the problem of very rapid coagulation of polymers during wet spinning as is the case with the spinning of cellulosic amine oxide solutions has been solved heretofore only by a combination of wet spinning and dry spinning.

It is, therefore, known to pass solutions of polymers into the coagulating medium via an air gap.

In EP-A-295,672, the production of aramide fibers is described. These fibers are brought via an air gap into a non-coagulating medium, stretched and then subjected to coagulation. East German Patent 218,124 describes a spinning of cellulose in amine oxide solution via an air gap in which precautions must be taken to prevent mutual adhesion of the elongated elements thus produced.

According to U.S. Pat. No. 4,501,886 cellulose triacetate can be spun using an air gap.

U.S. Pat. No. 3,414,645 describes the production of aromatic polymide articles from solution in a dry/wet spinning process. In all of these processes an orientation is effected in the air gap if only because the downwardly emergent solution strand from the orifice is at least stretched by the gravitational force on the strand of the solution emerging from the nozzle. The orientation effected by gravitational action can be increased when the velocity of the extruded solution emerging from the orifice and the withdrawal speed of the fibers passing through the coagulating bath are so adjusted that further stretching occurs.

A process of this latter type is described in Austrian Patent 387,792 and the equivalent U.S. Pat. No. 4,246,221 and U.S. Pat. No. 4,416,698.

In this system a solution of cellulose in NMKO (N-methylmorpholine-N-oxide) and water is formed. The stretching is effected with a stretching ratio of at least 3:1. For these purposes an air gap height as measured from the bottom of the nozzle to the top of the NMMO/water bath of 5 to 70 cm is necessary.

A drawback of this practice is that extremely high withdrawal speeds are required to carry off the strand and in order to insure that a minimum strand stretching ratio is obtained to provide corresponding textile characteristics of the spun filament. It has also been found that longer air gaps tend toward more sticking together of the fibers and especially at high draw ratio lead to unreliable results in the spinning operation and filament breakage.

As a consequence, precautions have been necessary to avoid these drawbacks. Austrian Patent 365663 and the equivalent U.S. Pat. No. 4,261,943 describe such precautions.

For large output operations, however, the number of holes provided in a spinning nozzle must be very high. In this case, precautions for limiting surface adhesion of the freshly extruded filaments which pass through the air gap into a coagulation bath are completely insufficient.

OBJECT OF THE INVENTION

It is, therefore, the principal object of the present invention to provide a cellulose spinning process which will avoid the drawbacks of the prior art processes as described.

Another object of the invention is to provide an improved spinning process which allows a relatively short air gap to be used with a rapidly acting solution to produce a filament with improved fiber or filament characteristics.

SUMMARY OF THE INVENTION

These objects and others which will become apparent hereinafter are attained in accordance with the invention in a method of forming filaments or fibers of the cellulose in an amine oxide solution, especially NMKO, utilizing a coagulating bath of water and NMMO wherein the solution strand is forced through an orifice which has a smallest diameter of at most 150 micrometers (/μm) preferably at most 70 micrometers (/μm) and a length of the nozzle or orifice of at least 1000 micrometers and preferably about 1500 micrometers (/μm).

We have found, surprisingly, that orifice nozzles which are so elongated and of such small diameter generate in the orifice passage shear forces which result in a significant orientation of the polymer.

As a consequence, fiber characteristics are imparted to the solution before it emerges from the orifice. The subsequent air gap can thus be comparatively small, e.g. of a length of at most 35 mn and preferably at most 10 mm.

The tendency of the process to disruption is greatly reduced. Titer variations are significantly lowered and thread breakage is rare or nonexistent. Because of the short air gap, neighboring threads do not readily adhere to one another so that the hole or orifice density, i.e., the number of spinneret orifices per unit area, can be increased, thereby increasing the productivity of the method and apparatus.

Furthermore, the spun threads are found to have good textile characteristics: Especially the elongation to break is improved. The average toughness, i.e., the product of elongation and tenacity, increases in inverse proportion to the hole diameter. The loop tenacity and the elongation to break associated with loop tenacity, which together represent important factors when the fiber is incorporated into a fabric, are also improved. Both of these factors can be found to improve with reduced hole diameter.

Advantageously the nozzle passages widens at its inlet side conically and is cylindrical at its outlet side. Nozzle passages of this configuration can be easily fabricated. For example it is difficult to make a passage of a length of 1500 /μm exactly of a diameter of say 100/μm. However, it is relatively simple to make a nozzle passage of this length when the minimum diameter exists only over an outlet side of say ¼ to ⅓ of the total length of the nozzle passage but conically widens away from this segment to the opposite end over the balance of the length of the passage.

BRIEF DESCRIPTION OF THE DRAWING

The above and other objects, features and advantages of the present invention will become more readily apparent from the following description, reference being made to the accompanying drawing, the sole FIGURE of which is a diagram partly in cross-section illustrating the principles of the invention.

SPECIFIC DESCRIPTION

In the drawing, the bottom wall or orifice plate 10 of the spinneret supplied with the solution 16 of cellulose NMMO and water by a pump 11, is formed with a multiplicity of elongated nozzle orifices or passages 13 from each of which a strand 30 of the solution is extruded under the pressure given by the pump 11 connected to the spinneret by the pipe 12.

Each orifice 13 is formed in the region of its outlet end with a cylindrical segment 15 of minimum diameter i.e., a diameter of at almost 150 /μm micrometers and preferably at most 70/μm, a practical lower limit is 25/μm.

From the cylindrical part of the orifice to the inlet side thereof the orifice passage can continually widen over a region 14 which can make up ¾ to ⅞ of the length of the passage Represented at L. The cylindrical segment 15 has a length which is ⅓ to ¼ of the length L. A preferred diameter for the cylindrical portion is 50 /μm.

The solution strand 30 then passes through an air gap 17 of a height H of at most 35 mm and preferably less than 10mm before encountering the surface 21 of a bath 25 of the coagulating solution which congeals the strand. The latter passes around rollers 22 and 23. When the roller 22 and 23 are operated with a peripheral speed greater than the speed which the strand emerges from the nozzle passages 13, i.e., the output velocity, the strand 30 is stretched in the region of the air gap. The fully coagulated strand at 24 may be rinsed, dried and wound up.

SPECIFIC EXAMPLES

The following examples utilize a solution prepared as follows: 2276 grams of cellulose (solid or dry content 94%) DP=750 (DP=average degree of polymerization) and 0.02% rutin as a stabilizer is suspended in 26139 grams of 60% aqueous NMMO solution.

Over a period of two hours at 100° C. and a vacuum drawn to 80 to 300 n bar, 9415 g of water are distilled off. The solution is checked by measuring its viscosity and by microscopic examination.

Parameters of the spinning solution:

10% Cellulose: Buckeye V5 (alpha=97.8%,
viscosity at 25° C. and 0.5 mass percent cellulose consistency: 10.8 cp 12% water:

78% NMMO:
complex viscosity of the spinning mass 1680 Pas at 95° C. RV20, Oscillation with w=0.31 (1/sec)

This solution is pressed at a spinning temperature of 75° C. through a spinneret and travels across an air gap of a length of 9 mm and then is passed through a precipitating bath consisting of 20% aqueous NMMO solution. Table 1 shows the characteristics of the fibers and the process parameters under various conditions.

| EXAMPLE | FFK cN/tex | FDK % | FFK* FDK | SF cN/tex | SD % | ORIFICE Length | DISPLACEMENT | HOLE NUMBER | HOLE DIAMETER | Ag m/min | EA m/min | STRETCH |
|---|---|---|---|---|---|---|---|---|---|---|---|---|
| 1 | 37.9 | 8.5 | 322 | 16.3 | 2.5 | 200 | 56.2 | 910 | 130 | 3.9 | 19.8 | 5.1 |
| 2 | 35.1 | 9.7 | 340 | — | — | 450 | 63.9 | 800 | 120 | 5.9 | 28 | 4.75 |
| 3 | 38.5 | 10.2 | 393 | — | — | 450 | 63.9 | 800 | 120 | 5.9 | 44.6 | 7.58 |
| 4 | 42.7 | 11.4 | 487 | 18.1 | — | 1500*) | 54.8 | 1147 | 100 | 5.1 | 30.6 | 6.03 |
| 5 | 46.5 | 10.1 | 470 | 19.4 | 2.4 | 1500*) | 98.2 | 1891 | 130 | 3.3 | 22.2 | 6.8 |

-continued

| EX-AM-PLE | FFK cN/tex | FDK % | FFK* FDK | SF cN/tex | SD % | ORIFICE Length | DISPLACE-MENT | HOLE NUMBER | HOLE DIAMETER | Ag m/min | EA m/min | STRETCH |
|---|---|---|---|---|---|---|---|---|---|---|---|---|
| 6 | 47.8 | 15.4 | 736 | 26.9 | 6.4 | 1500*) | 29.8 | 1147 | 50 | 11.1 | 16.0 | 1.4 |

Legend:
FFK CONDITIONED TENACITY OF THE FIBER
FDK ELONGATION TO BREAK
FFK*FDK PRODUCT OF TENACITY AND ELONGATION (MEASURE OF TOUGHNESS)
SF LOOP TENACITY
SD ELONGATION ON MEASUREMENT OF LOOP TENACITY
Ag OUTPUT VELOCITY
EA WITHDRAWAL VELOCITY
EA/AG STRETCHING RATIO
*The nozzle orifice had a conical inlet (angle - 8°). Only the last 430 μm was cylindrical. The hole diameter applies cylindrical segment.

In Table 1: Examples 1 through 3 are provided only for comparison. Examples 4 through 6 are directed to the invention.

Especially significant is the value of 47.8 for the conditioned tenacity of Example 6. Such a value can be achieved with conventional nozzles only with stretching factors of 100.

From a comparison of Examples 1 through 3 with Examples 4 through 6 it will be immediately apparent that the use of the elongated nozzle passages of the invention also improves the elongation to break and from Examples 4–6 it is also apparent that the average toughness (FFK * FDK) loop tenacity and elongation to break associated therewith increases with decreasing orifice diameter.

A comparison of Examples 1 and 5 for which the hole diameters are identical shows the improvement to be dependent upon the length of the orifice for a given diameter.

Examples 2 and 3 show that at smaller orifice passage lengths the characteristics of the fiber are dependent upon the stretching in the air gap and increase with greater stretching.

Examples 4 & 5 indicate that under comparable conditions in terms of stretching and hole diameter all of the textile characteristics can be improved with the elongated orifice of the invention significantly with the exception of elongation to break. Example 6 indicates that by the use of a minimum hole diameter of 50 /μm, all of the textile properties discussed greatly increase.

We claim:

1. A process for producing cellulosic filaments comprising the steps of:
   (a) extruding under pressure a solution of cellulose in an amine oxide and water through a nozzle orifice having a length of at least 1000 /μm and a minimum diameter along said length of at most 150 /μm to produce a strand of said solution;
   (b) conducting said strand of said solution across an air gap; and
   (c) thereafter passing said strand into a coagulating bath thereby solidifying said strand into a cellulosic filament.

2. The process defined in claim 1 wherein the air gap has a length of at most 35 mm.

3. The process defined in claim 1 wherein said gap has a length of at most 10 mm.

4. The process defined in claim 1 wherein said minimum diameter is at most 70 /μm.

5. The process defined in claim 4 wherein said length is about 1500 /μm

6. The process defined in claim 1 wherein said orifice has a cylindrical part adjacent an outlet end of said orifice and conically widens therefrom to an inlet end thereof.

7. The procedure defined in claim 6 wherein said cylindrical part extends about to ⅓ to ¼ of the length of said orifice.

* * * * *